US005186650A

United States Patent [19]

Hwang

[11] Patent Number: 5,186,650

[45] Date of Patent: Feb. 16, 1993

[54] QUICK DETACHABLE ELECTRIC DEVICE

[76] Inventor: Haw C. Hwang, No. 3, Lane 21, Hsing Der Rd., Taipei, Taiwan

[21] Appl. No.: 879,285

[22] Filed: May 7, 1992

[51] Int. Cl.[5] ..... H01R 13/58

[52] U.S. Cl. ..... 439/463; 439/687; 439/696

[58] Field of Search ..... 439/463, 687, 690, 696, 439/701

[56] References Cited

U.S. PATENT DOCUMENTS 2,590,886 4/1952 Pedersen ..... 439/463
3,437,981 4/1969 Keller ..... 439/463
4,566,187 1/1986 Chen ..... 439/696

FOREIGN PATENT DOCUMENTS 1227567 4/1971 United Kingdom ..... 439/463

*Primary Examiner*—Gary F. Paumen

[57] ABSTRACT

An electric device, which may be made in the form of an electric plug or receptacle, comprising an eccentric locating device inserted in a side hole on the casing above the wire holes thereof and rotated into operative position to hold down an electric line in place permitting the electric wires of said electric line to be respectively electrically connected to a plurality of conductive plates inside the casing thereof, or non-operative position to release said electric line permitting said electric wires to be pushed away from said conductive plates by compression springs.

5 Claims, 8 Drawing Sheets

QUICK DETACHABLE ELECTRIC DEVICE

BACKGROUND OF THE INVENTION

The present invention relates to an electric device which can be conveniently quickly connected to an electric line or detached therefrom. The electric device may be made in the form of an electric plug or receptacle.

An electric plug or receptacle is generally comprised of a casing having a plurality of conductive plates fastened on the inside and respectively connected to the electric wires of an electric line. The casing is generally made of an insulative material and consisted of two half parts, which are connected by screws. The common disadvantage of this structure of electric device is the complicated procedure in connecting the electric wires of an electric line to the conductive plates. In case of broken circuit, the two half parts of the casing should be detached from each other permitting the electric wires of the electric line to be respectively connected to the conductive plates again. After connection of the electric wires to the conductive plates, the two half parts of the casing are fastened together again.

SUMMARY OF THE INVENTION

The present invention has been accomplished to eliminate the aforesaid disadvantages. It is therefore an object of the present invention to provide an electric device which can be conveniently quickly connected to an electric line or detached therefrom without detaching the outer shell thereof. It is another object of the present invention to provide an electric device which can be made in the form of an electric plug or receptacle.

According to the present invention, an electric device is generally comprised of a plurality of conductive plates fastened inside a casing and connected with a plurality of conductive cylindrical clamping plates respectively, a plurality of compression springs respectively sleeved on the conductive cylindrical clamping plates, an electric line consisted of a plurality of electric wires that are attached with cap clamps and respectively inserted through wire holes on the casing into holes on the conductive cylindrical clamping plates, and an eccentric locating device inserted in a side hole on the casing above and rotated into operative position to hold down the electric line in place permitting the electric wires of the electric line to be respectively electrically connected to the conductive plates through the conductive cylindrical clamping plates, or non-operative position to release the electric line permitting the electric wires to be pushed away from the conductive cylindrical clamping plates by the compression springs.

DETAILED DESCRIPTION OF THE PREFERRED EMBODIMENTS

Figure 1:
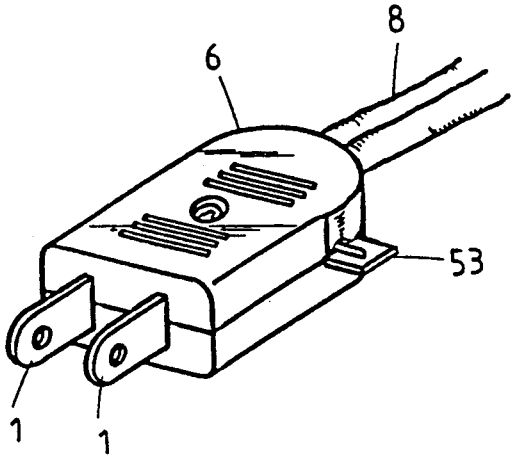
FIG. 1 is an elevational view of an electric plug as constructed in accordance with the present invention.
Figure 2:
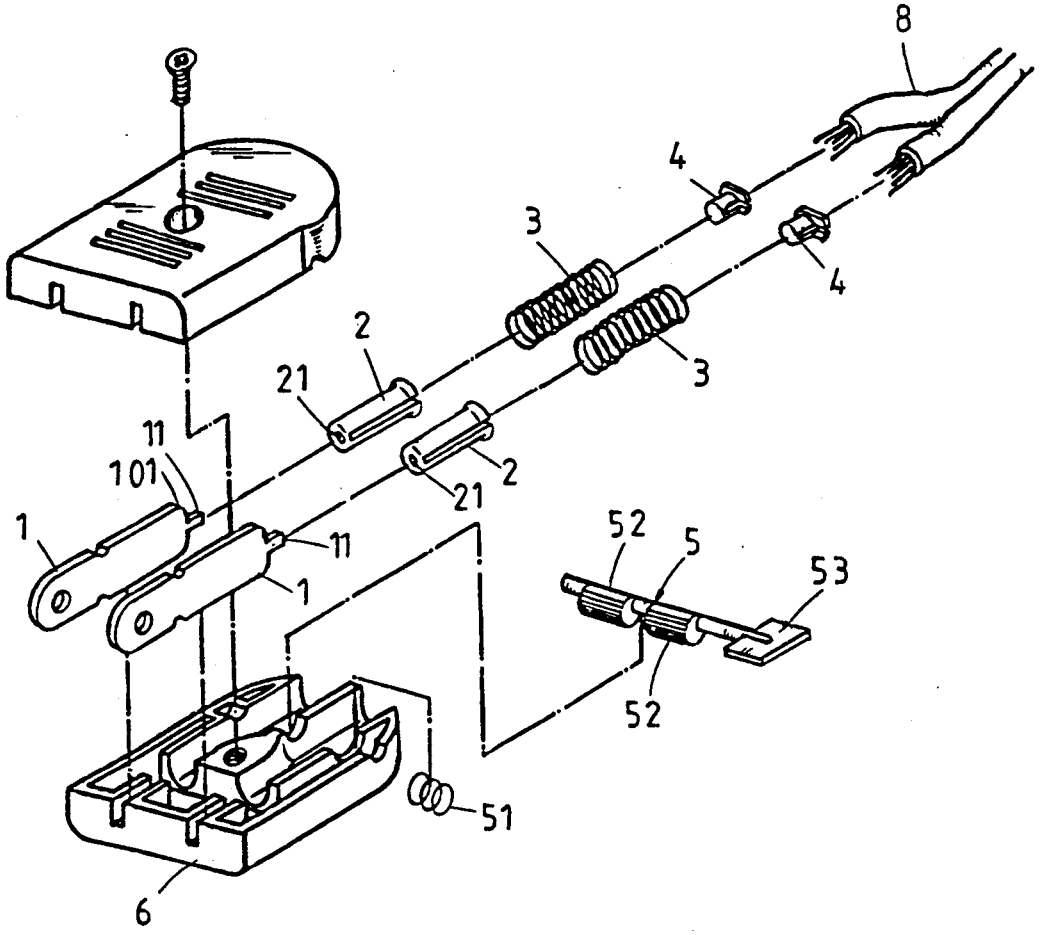
FIG. 2 is an exploded view of the electric plug of FIG. 1.
Figure 3:
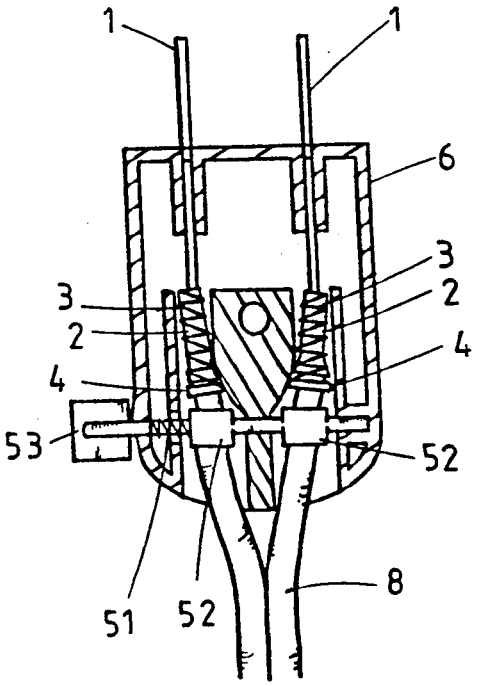
FIG. 3 is a sectional view of the electric plug of FIG. 1.
Figure 7:
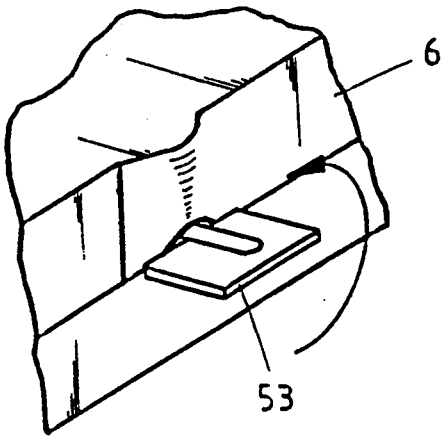
FIG. 7 illustrates that the finger plate of the eccentric locating device extends out of the electric plug for driving.

Referring to FIGS. 1, 2 and 3, therein illustrated is an electric plug constructed in accordance with the present invention which is designated at 6. The two conductive plates 1 (namely, the two projecting prongs) of the electric plug 6 have each a projecting end rod 11 welded to a hole 21 on a conductive cylindrical clamping plate 2, which is sleeved with a compression spring 3. The compression spring 3 is relatively longer than the conductive cylindrical clamping plate 2 so that the conductive cylindrical clamping plate 2 is completely received inside the compression spring 3. An eccentric locating device 5 is transversely fastened in the electric plug 6 near the conductor inlet holes, into which the conductors of the electric line 8 are inserted. The eccentric locating device 5 comprises one set of eccentric shafts, namely, two eccentric shafts 52 longitudinally aligned, and a finger plate 53. When attached with a spring 51, the eccentric locating device 5 is inserted in a hole (not indicated) on the electric plug 6 and retained in place with the finger plate 53 thereof disposed out of the outer shell of the electric plug. As soon as the conductors of the electric line 8 are respectively attached with cap clamps 4, they are inserted into the conductor inlet holes on the electric plug, and then the eccentric shafts 52 are rotated by the finger plate 53 to firmly retain the electric line 8 in place (see also FIGS. 7 and 8), permitting the conductors thereof to be respectively electrically connected to the conducting plates 1 through the conductive cylindrical clamping plates 2.

Figure 4:
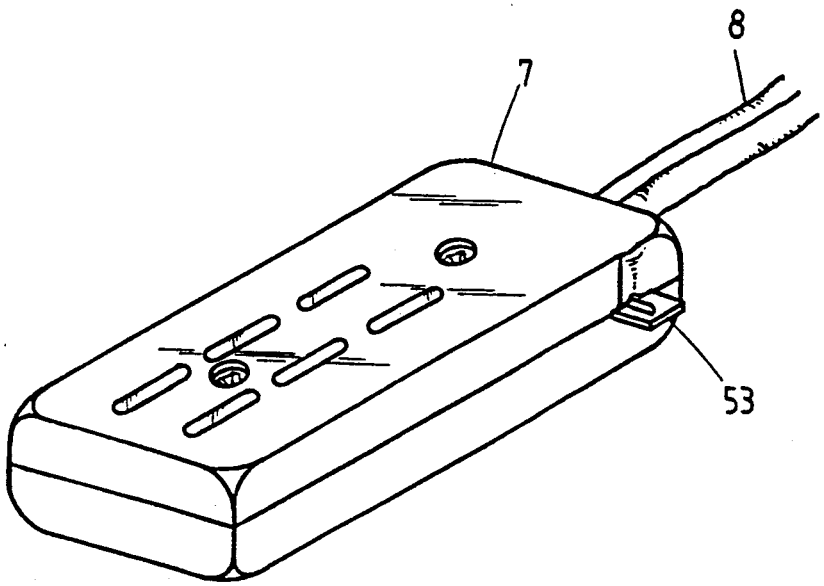
FIG. 4 is an elevational view of an electric receptacle as constructed in accordance with the present invention.
Figure 5:
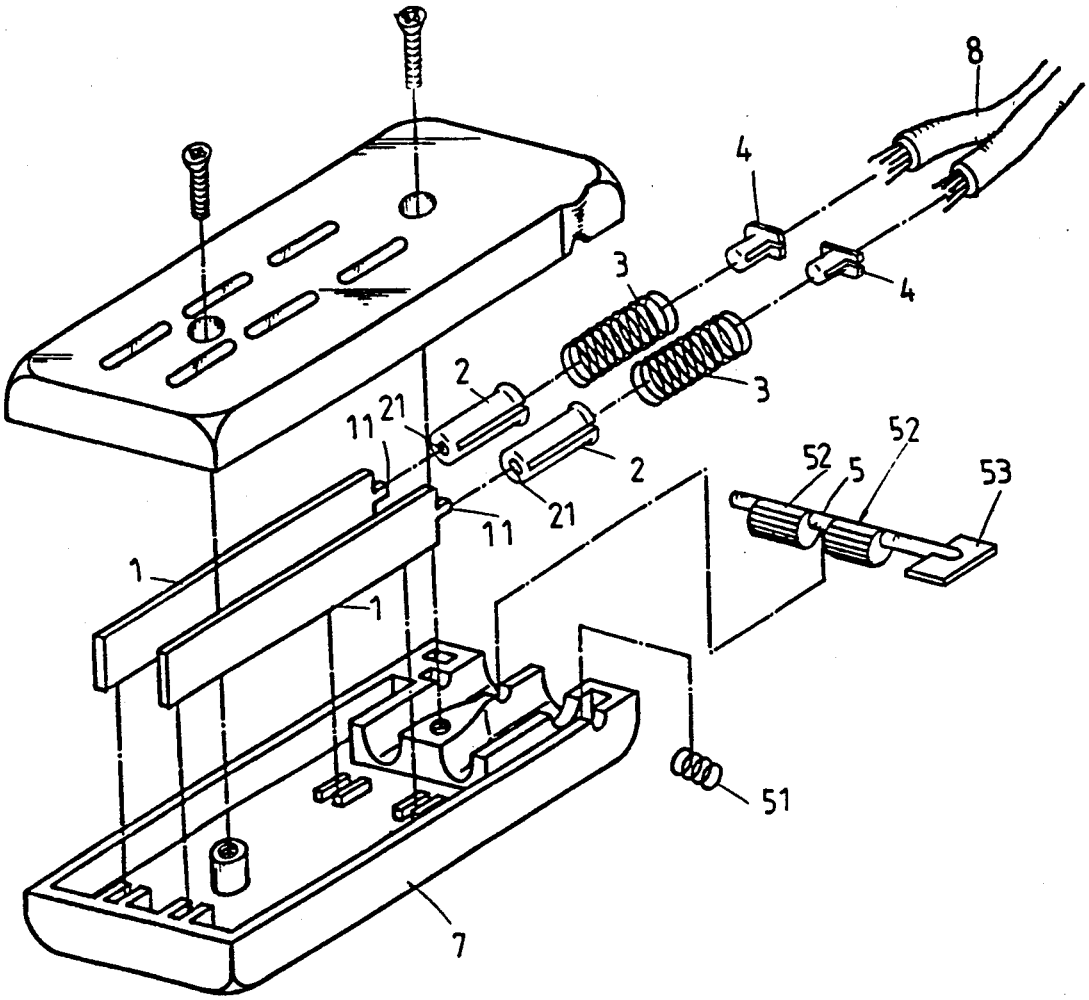
FIG. 5 is an exploded view of the electric receptacle of FIG. 4.
Figure 6:
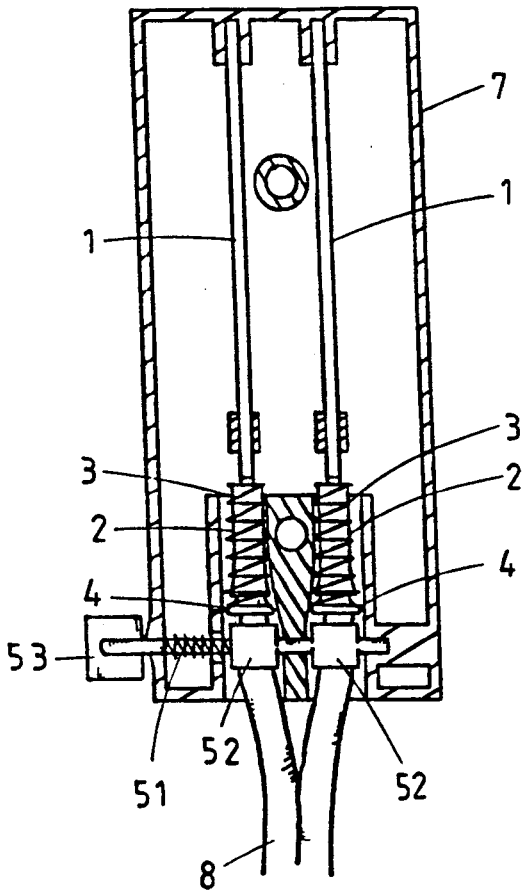
FIG. 6 is a sectional view of the electric receptacle of FIG. 4.

Referring to FIGS. 4, 5 and 6, therein illustrated is an electric receptacle, which is identified by a reference numeral 6, as constructed in accordance with the present invention. The internal structure of the electric receptacle is similar to the aforesaid electric plug, wherein like numerals represent like elements.

Figure 9:
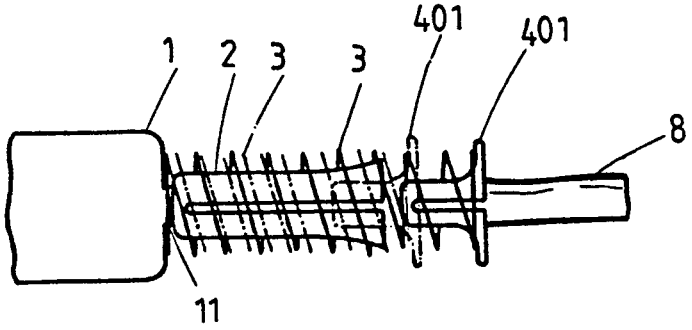
FIG. 9 illustrates that each wire of the electric line is inserted in each conductive cylindrical clamping plate permitting the corresponding compression spring to be squeezed between the shoulder portion of the corresponding conductive plate and the flange of the corresponding cap clamp.

Referring to FIG. 9, when the projecting end rod 11 of each conductive plate 1 was welded to each conductive cylindrical clamping plate 2, the conductors of the electric line 8 are respectively attached with cap clamps 4 and then respectively inserted into each conductive cylindrical clamping plate 2 causing each compression spring 3 to be compressed and stopped between the shoulder portion 101 around the projecting end rod 11 of each conductive plate 1 and the flange 401 on each cap clamp 4. In FIG. 9, the dotted line indicates that the electric line has been retained in the "connected position"; the solid line indicates that the electric line has been released from the "connected position".

Figure 8:
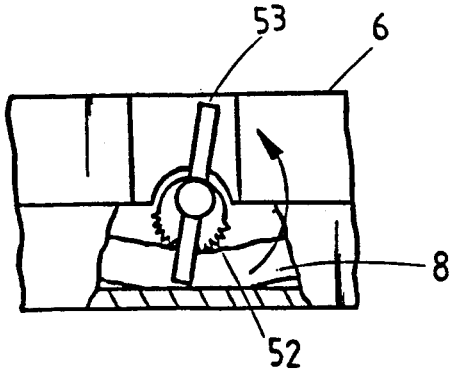
FIG. 8 illustrates that rotating the finger plate causes the electric line to be squeezed by the eccentric shafts and firmly retained in place.

Referring to FIG. 8, rotating the finger plate 53 into vertical position causes the electric line 8 to be tightly squeezed by the eccentric shafts 52, and therefore the electric line 8 is firmly retained in place; rotating the finger plate 53 back to its original horizontal position (see FIG. 7) causes the electric line 8 to be released from the constraint of the eccentric shafts 52. Once the electric line 8 has been released from the eccentric shafts 52, the compression springs 3 automatically return to their original shape causing the electric line 8 and the cap clamps 4 thereon to be simultaneously pushed outwards from the conductive cylindrical clamping plate 2.

By means of the aforesaid arrangement, an electric plug or receptacle can be conveniently quickly detached for inspection and repair.

What is claimed is:

1. An electric device comprising a casing having a plurality of conductive plates fastened on the inside, said conductive plates each having a projecting end rod, a plurality of conductive cylindrical clamping plates respectively welded to the projecting end rod of each conductive plate, a plurality of compression springs respectively sleeved on said conductive cylindrical clamping plates, an electric line consisted of a plurality of electric wires, said electric wires being attached with cap clamps and respectively inserted through wire holes on said casing into holes on said conductive cylindrical clamping plates, and an eccentric locating device inserted in a side hole on said casing above said wire holes and rotated into operative position to hold down said electric line in place permitting said electric wires to be respectively electrically connected to said conductive plates through said conductive cylindrical clamping plates, or non-operative position to release said electric line permitting said electric wires to be pushed away from said conductive cylindrical clamping plates by said compression springs.

2. The electric device according to claim 1, which is an electric plug.

3. The electric device according to claim 1, which is an electric receptacle.

4. The electric device according to claim 1, wherein said eccentric locating device has a finger plate extended out of said casing for rotating by the hand.

5. The electric device according to claim 1, wherein said compression springs each have one end stopped against a shoulder portion around the projecting end rod of a respective conductive plate, and an opposite end stopped against a flange on a respective cap clamp.

* * * * *